US006374900B1

(12) United States Patent
Campbell

(10) Patent No.: US 6,374,900 B1
(45) Date of Patent: Apr. 23, 2002

(54) UPPER MOULD HOLDER FOR A DIE HOLDER ASSEMBLY USED IN DIE-CASTING MACHINES

(75) Inventor: David Campbell, Atwood, TN (US)

(73) Assignee: Emerson Electric Co., St. Louis, MO (US)

( * ) Notice: Subject to any disclaimer, the term of this patent is extended or adjusted under 35 U.S.C. 154(b) by 0 days.

(21) Appl. No.: 09/698,744

(22) Filed: Oct. 27, 2000

(51) Int. Cl.[7] ..... B22D 17/08; B22D 33/04; B22D 27/11

(52) U.S. Cl. ..... 164/312; 164/121; 164/341; 425/168; 425/183

(58) Field of Search ..... 164/312, 341, 164/342, 113, 137, 121; 425/168, 183

(56) References Cited

U.S. PATENT DOCUMENTS

| | | | | | |
|---|---|---|---|---|---|
| 2,748,434 | A | * | 6/1956 | Amo | 164/342 |
| 2,797,455 | A | * | 7/1957 | Schrecongost | 22/92 |
| 2,848,771 | A | * | 8/1958 | Eggenberger | 164/342 |
| 4,828,479 | A | * | 5/1989 | Pleasant | 425/192 R |
| 5,261,806 | A | * | 11/1993 | Pleasant | 425/144 |
| 5,916,603 | A | * | 6/1999 | Pleasant et al. | 425/182 |

* cited by examiner

*Primary Examiner*—M. Alexandra Elve
*Assistant Examiner*—Len Tran
(74) *Attorney, Agent, or Firm*—Harness, Dickey & Pierce, P.L.C.

(57) ABSTRACT

A die-casting assembly includes a ram and a ram adapter that is connected to the ram. The die-casting assembly further includes a mould holder and a mould that is connected to the mould holder. An attachment device includes a clamp cylinder having an end that removably connects the mould holder to the ram adapter. The mould holder includes a clamp ring that defines a radially projecting engagement flange. The upper mould holder includes a body segment having an upper surface that is removably connected to the clamp ring in a plurality of angular positions. When the clamp ring is damaged during use, the clamp ring can be loosened, rotated relative to the body segment, and tightened to the body segment without requiring repair or replacement. The clamp ring is annular and includes a first plurality of axial bores that provide access to leader pins that are connected to the body segment. The clamp ring includes a second plurality of bores arranged in a first pattern for receiving fasteners that connect the clamp ring to the body segment. The body segment includes a third plurality of bores arranged in a second pattern for receiving the fasteners that connect the clamp ring to the body segment. The first and second patterns align in a plurality of angular positions to allow the clamp ring to be rotated when the clamp ring is damaged.

21 Claims, 5 Drawing Sheets

UPPER MOULD HOLDER FOR A DIE HOLDER ASSEMBLY USED IN DIE-CASTING MACHINES

FIELD OF THE INVENTION

This invention relates to die-casting machines and, more particularly to a die holder assembly having an upper mould holder with a clamp ring and a body segment.

BACKGROUND OF THE INVENTION

As is well known, die-castings are produced by forcing a molten metal under pressure into one or more die cavities that are machined into a die set or into cavities that are machined, die-cut or otherwise formed in a part. For example, one exemplary part is a rotor for an electric machine. The rotor typically includes a stack of laminations that are die cut from a lamination material. The rotor laminations include rotor bar bores into which aluminum is die cast. Oftentimes, end rings are die cast on opposite ends of the stack of laminations.

A die-casting machine typically includes an upper mould and a lower mould. The die-casting machine also includes an injection system for delivering molten material, such as aluminum into the die cavity and an ejector system for ejecting the casting from the die cavity. As is conventional in horizontal die-casting machines, the lower mould is secured to the stationary cover platen while the upper mould is secured to the moveable ejector platen. The shot of molten metal is typically injected into the cavity in the part through the lower mould. Ejector pins that are associated with the ejector system extend through access holes that are formed in the upper mould. The ejector platen is mounted to a power-operated ram that is actuated to open and close the upper and lower moulds.

In order to reduce the time that is required for die changes, it is known to preassemble the die set into a die holder assembly that includes upper and lower mould holders. The upper mould holder is mounted to the ram and the lower mould holder is mounted to the stationary cover platen. To permit utilization of the die holder assembly with most die-casting machines, the upper and lower mould holders include access bores to accommodate such things as leader pins, ejector pins, and clamps for mounting the die set thereto.

An exemplary die-casting machine according to the prior art is illustrated in FIG. 1A and is generally designated 10. The die-casting machine 10 includes a frame 12 with a pair of left-side tie bars 14 and a pair of right-side tie bars 16. Upper and lower platens 20 and 22 extend between the tie bars 14 and 16. An upper ram 26 is connected to an upper ram adapter 28 that defines a mounting chamber 30 in a downwardly-facing direction. Horizontal clamp cylinders 32 and 36 extend inwardly into the mounting chamber 30. The horizontal clamp cylinders 32 and 36 reciprocally move clamp wedges 38 and 40 inwardly and outwardly in a horizontal direction. The clamp wedges 38 and 40 in conjunction with the clamp cylinders 32 and 36 releasably engage an upper mould holder 50.

The upper mould holder 50 defines an annular recess 54 on an outer surface thereof that engages the clamp wedges 38 and 40. A bottom portion 56 of the upper mould holder 50 is removably attached to upper moulds 60 and 62 that include downwardly-facing pilot projections 64. A lower mould holder 74 includes sleeves 76 and 78 for receiving the leader pins 70 and 66, respectively. A top portion 80 of the lower mould holder 74 is removably attached to lower moulds 82 and 84. The lower moulds 82 and 84 include upwardly-facing pilot projections 86. A shot ram 88 is connected to the lower mould holder 74.

Referring now to FIGS. 1A, 1B, and 1C, the projections 64 of the upper moulds 60 and 62 and the projections 86 of the lower moulds 82 and 84 are received by a rotor shaft bore 90 that is formed by a stack of interconnected rotor laminations 91. The rotor laminations 91 typically have a circular cross-section and include rotor bar bores 92 that are located adjacent a radially outer surface 93 thereof. The rotor bar bores 92 of the adjacent laminations 91 are offset or skewed at a skew angle 94 that is typically between 2 to 10 degrees. In other words, a first rotor is rotated at the skew angle relative to the adjacent rotor laminations 91. The rotor laminations 91 also include interconnects 95 that are typically formed by making die cuts that are deformed using a punch. The deformed punched portion of the die cuts in one lamination 91 is received by the die cut of an adjacent lamination 91. The interconnects 95 hold the rotor laminations 91 together during assembly. The upper and lower moulds 60, 62, 82, and 84 typically define end ring cavities (not shown) that are located adjacent opposite ends of the stack of rotor laminations 91. The molten aluminum enters the end ring cavities to create end rings 96.

When the injector pins inject molten metal such as aluminum into the rotor bar bores 92-1, the molten metal moves under pressure into one of the end ring cavities. Then, the molten metal moves under pressure back through the rotor bar bores 92-2 and into the other end ring cavity 96-2.

When the upper mould holder 50 is to be changed and/or worked on, the upper mould holder 50 is typically lowered onto the lower mould holder 74 or any other suitable support. The clamp cylinders 32 and 36 are fully retracted to move the clamp wedges 38 and 40 out of the annular recess 54. The upper ram 26 is moved upwardly to allow access to the upper mould holder 50. In other words, the upper mould holder 50 is released from the upper ram 26 and the upper ram adapter 28. Work is completed on the upper mould holder 50 or a different upper mould holder 50 is installed. The process is reversed to reattach the upper mould holder 50.

Oftentimes when the technicians attempt to reattach the upper mould holder 50 to the upper ram adapter 28, the technicians fail to retract the clamp cylinders 32 and 36. This is due, in part, to the visually obstructed position of the clamp wedges 38 and 40 that are located in the mounting chamber 30 of the upper ram adapter 28. When the technicians lower the upper ram 26 and the upper ram adapter 28 over the upper mould holder 50, the clamp wedges 38 and 40 damage a radially outer edge 92 of an upper surface 94 of the upper mould holder 50. The damage to the upper mould holder 50 can, in some cases, be repaired. The repairs, however, can be expensive. Even if the upper mould holder 50 can be repaired, subsequent accidents permanently damage the upper mould holder 50 requiring replacement.

SUMMARY OF THE INVENTION

A die-casting assembly according to the invention includes a ram and a ram adapter that is connected to the ram. The die-casting assembly further includes a mould holder and a mould that is connected to the mould holder. An attachment device includes a clamp cylinder having an end that removably connects the mould holder to the ram adapter. The mould holder includes a clamp ring that defines a radially projecting engagement flange. The upper mould holder includes a body segment having an upper surface that is removably connected to the clamp ring in a plurality of angular positions. When the clamp ring is damaged during use, the clamp ring can be rotated a plurality of times relative to the body segment without requiring repair or replacement of the upper mould holder.

In other features of the invention, the clamp ring is annular and includes a first plurality of axial bores that provide access to leader pins that are connected to the body segment. The access bores allow the leader pins to be adjusted, removed or replaced without removing the clamp ring. The clamp ring includes a second plurality of bores arranged in a first pattern for receiving bolts that connect the clamp ring to the body segment. The body segment includes a third plurality of bores arranged in a second pattern for receiving the bolts that connect the clamp ring to the body segment. The first and second patterns are positioned and arranged to allow the clamp ring to be rotated in a plurality of angular positions. Thus, the clamp ring can be rotated several times relative to the body segment when damage occurs without requiring repair or replacement of the clamp ring.

In other features of the invention, an improved mould holder includes a clamp ring with an engagement flange that projects radially from an inner surface. A first plurality of bores in the inner surface are arranged in a first pattern. The body segment defines a shoulder and a second plurality of bores arranged in a second pattern. The first and second patterns align in a plurality of angular positions. The engagement flange of the clamp ring and the shoulder of the body segment define a recess for receiving and engaging one end of a clamp cylinder.

In still other features of the invention, the clamp ring includes four axial leader pin bores in the inner surface that are spaced 90 degrees apart. The first plurality of fastening bores are located between the axial leader pin bores and are spaced 30 degrees apart. The body segment includes two axial access bores that are spaced 180 degrees apart and a first and second pair of fastening bores that are located on opposite sides of the axial access bores and are spaced at 30 degree intervals. The clamp ring and the body segment allow the clamp ring to be rotated 90 degrees and refastened when damage occurs. The leader pins that are connected to the body segment can be accessed without removing the clamp ring.

In other features of the invention, the fastening bores on the clamp ring are spaced at 60 degree intervals. The body segment includes two axial access bores that are spaced 180 degrees apart. The fastening bores on the body segment are spaced at 60 degree intervals. The clamp ring and the body segment allow the clamp ring to be rotated 60 degrees and refastened when damage occurs.

Still other objects, features and advantages will be readily apparent from the specification, the drawings and the claims.

DETAILED DESCRIPTION OF THE PREFERRED EMBODIMENTS

The ensuing detailed description provides preferred exemplary embodiments only and is not intended to limit the scope, applicability or configuration of the present invention. Rather, the ensuing detailed description of the preferred exemplary embodiments will provide those skilled in the art with an enabling description for implementing the preferred exemplary embodiments of the invention. It being understood that various changes may be made in the function and arrangement of the elements without departing from the spirit and scope of the invention as set forth in the appended claims.

A novel rotatable and/or replaceable clamp ring and body segment according to the invention replace the conventional upper mould holder in die-casting machines. When accidentally damaged by the clamp wedges when the upper ram is positioned over the upper mould holder, the clamp ring can be loosened, rotated relative to the body segment and tightened. In other words, the clamp ring can be reused one or more times after being damaged before replacement is required. When replacement is required after multiple accidents, a new clamp ring is installed on the body segment without requiring the replacement of the body segment.

Figure 1A:
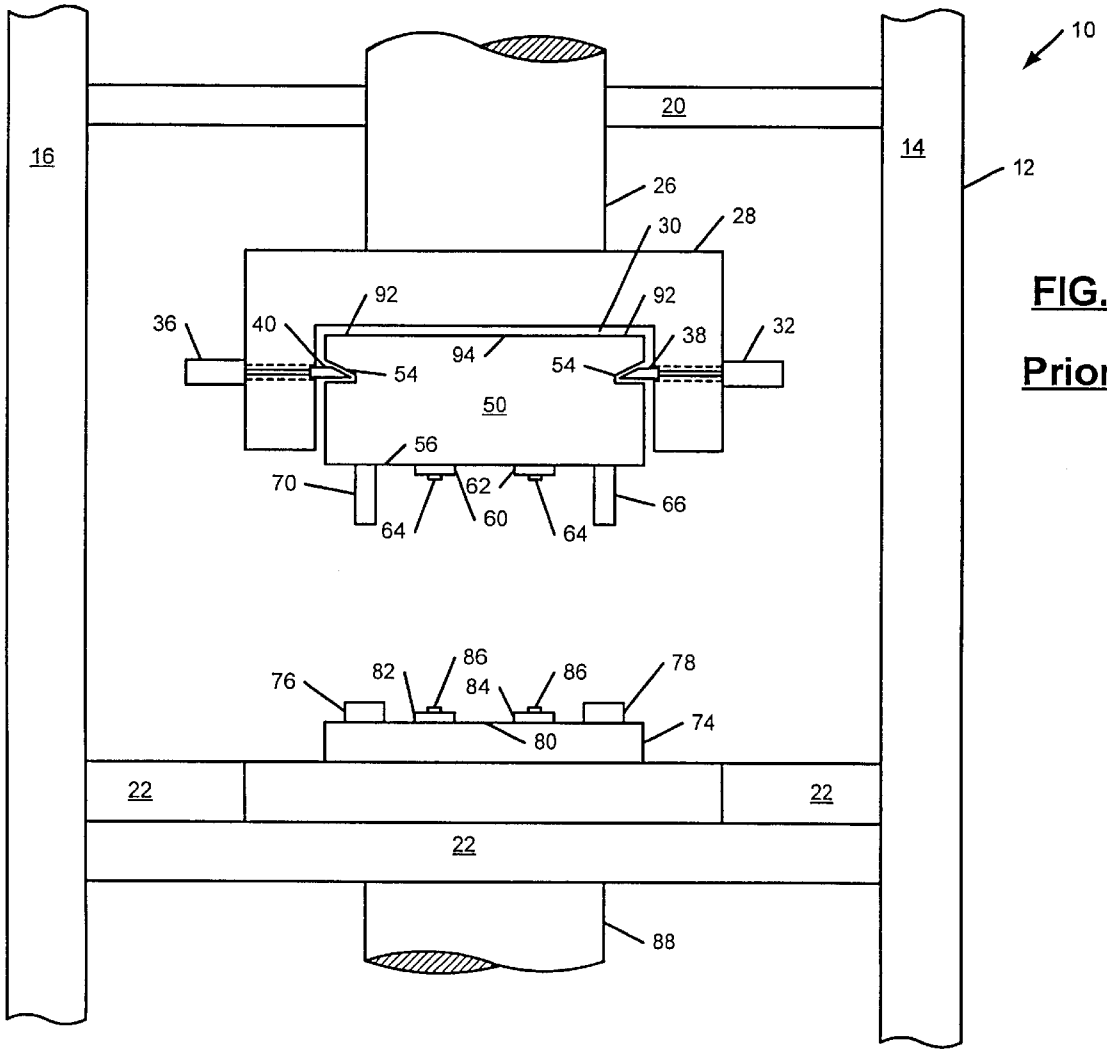
FIG. 1A Prior Art
FIG. 1A illustrates an exemplary die-casting machine equipped with a conventional die holder assembly.
Figures 1B, 1C:
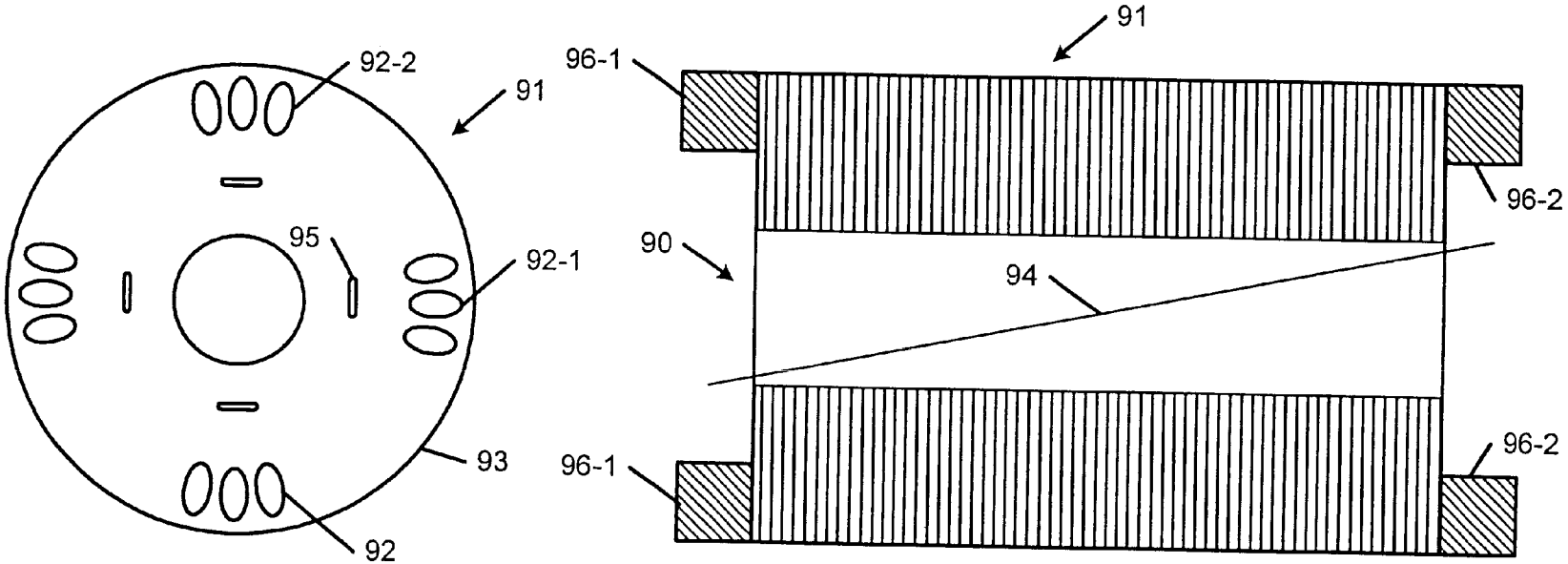
FIG. 1C Prior Art
FIG. 1B Prior Art
FIG. 1B illustrates a rotor lamination including rotor bar bores into which molten metal is die cast.
FIG. 1C illustrates a sectional view of the rotor that is depicted in FIG. 1B.
Figure 2:
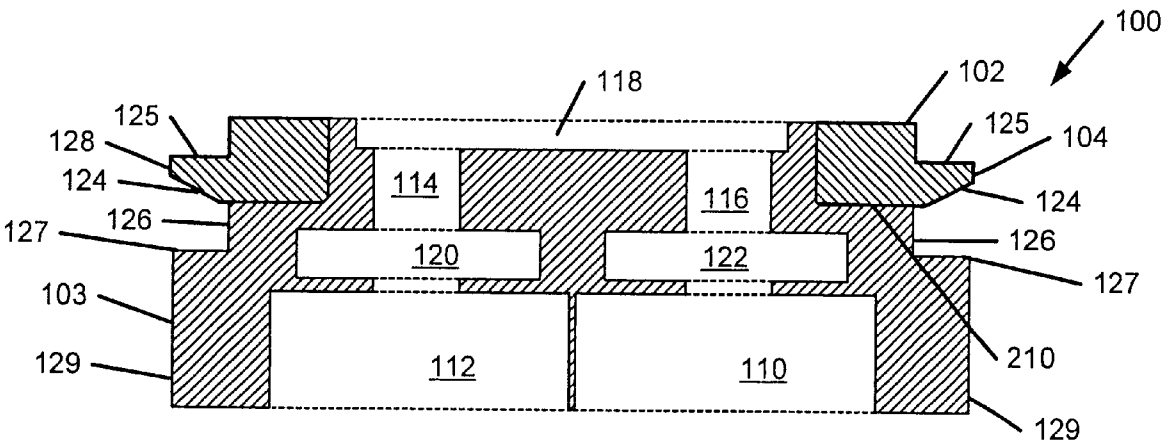
FIG. 2 illustrates a sectional view of an upper mould holder associated with an improved die holder assembly according to the present invention.

Referring now to FIG. 2, an upper mould holder 100 according to the present invention is shown. The upper mould holder 100 includes a rotatable and/or replaceable clamp ring 102 and a body segment 103. The clamp ring 102 defines a radially extending engagement flange 104 that abuts the clamp wedges 38 and 40 when the clamp wedges 38 and 40 are extended by the clamp cylinders 32 and 36. The clamp ring 102 includes a plurality of bores (not shown) for receiving threaded bolts that removably connect the clamp ring 102 to the body segment 103. By removing fastening bolts that are received in the bores, the clamp ring 102 can be rotated relative to the body segment 103 and refastened using the bolts. The body segment 103 defines mould openings 110 and 112, connecting bores 114 and 116 and a cylindrical opening 118. Upper cylindrical mould cavities 120 and 122 are located between the mould openings 110 and 112, respectively and the connecting bores 114 and 116, respectively.

The radially extending engagement flange 104 that is defined by the clamp ring 102 includes a sloped surface 124 that abuts the clamp wedges 38 and 40 preventing vertical movement of the clamp ring 102 and the body segment 103 relative to the upper ram 26 and the upper ram adapter 28. When an upper surface 125 of the radially extending engagement flange 104 is damaged by the extended clamp wedges 38 and 40, the clamp ring 102 can be loosened, rotated relative to the body segment 103 (one or more times before replacement is required) and tightened. The clamp ring according to the invention reduces the need for reworking and/or replacing the entire upper mould holder 100 and/or the clamp ring 102 after being damaged by the clamp wedges 38 and 40.

The body segment 103 defines a shoulder with an axially facing wall 126 and a radially facing wall 127. A recess defined by the sloped surface 124, the axially facing wall 126 and the radially facing wall 127 receives the clamp wedges 38 and 40. The walls 126 and 127 define a shoulder. Preferably, an axially facing wall 129 of the body segment 103 is generally parallel to an axially facing wall 128 of the radially extending engagement flange 104.

Figure 3:
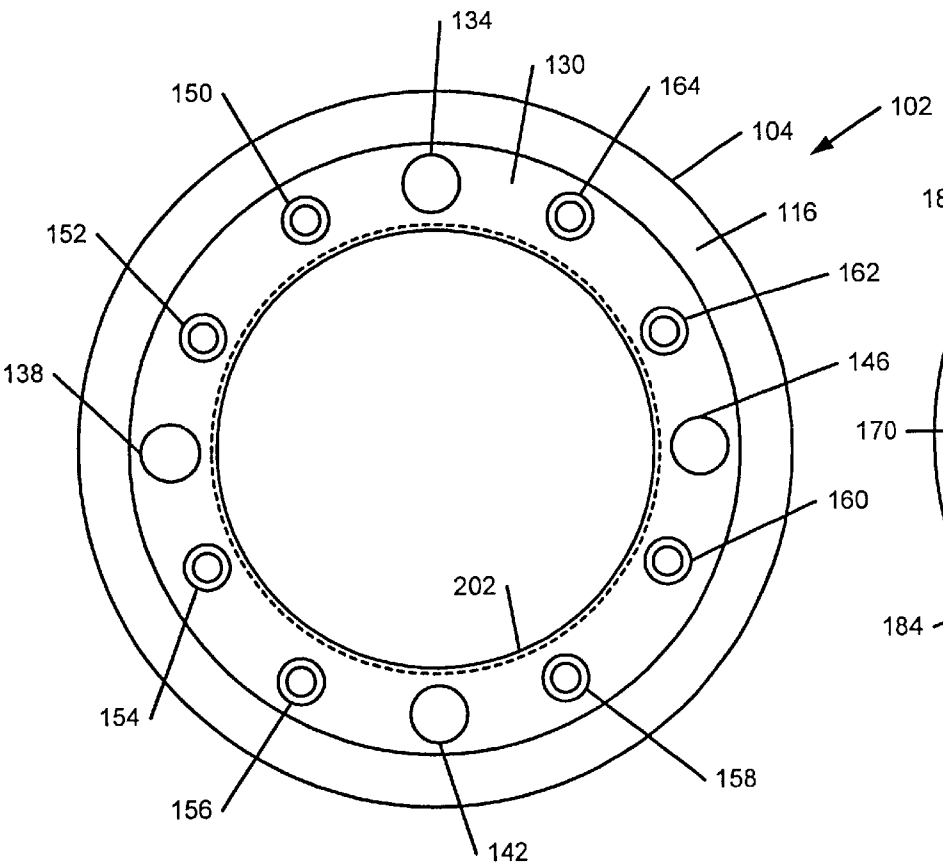
FIG. 3 is a plan view of the removable clamp ring associated with the die holder assembly shown in FIG. 2.

Referring now to FIG. 3, an upper and radially inner surface 130 of the clamp ring 102 includes a plurality of leader pin access bores 134, 138, 142 and 146 that are preferably spaced at 90 degree intervals. Fastener receiving bores 150 and 152 are spaced at 30 degree intervals between the bores 134 and 138. Likewise, fastener receiving bores 154 and 156 are spaced at 30 degree intervals relative to the leader pin access bores 138 and 142. Fastener receiving bores 158 and 160 are spaced at 30 degree intervals between the leader pin access bores 142 and 146. Fastener receiving bores 162 and 164 are spaced at 30 degree intervals between the leader pin access bores 146 and 134. The fastener receiving bores 150–164 are countersunk to allow the heads of the fastening bolts to be flush with the surface 130.

Figure 4:
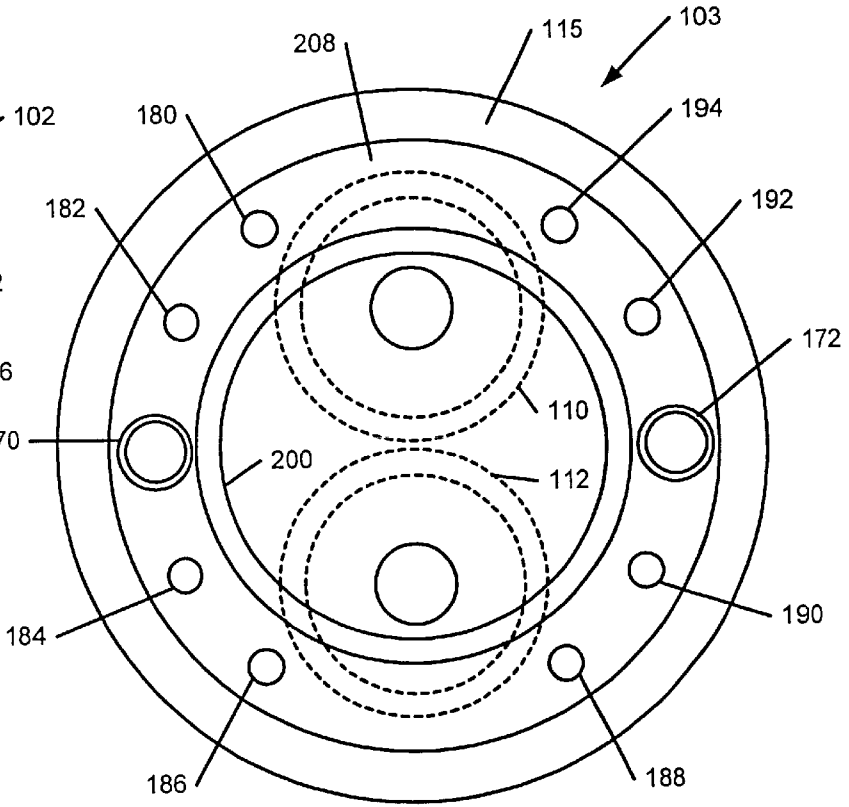
FIG. 4 is a plan view of the body segment of the die holder assembly shown in FIG. 2.

Referring now to FIG. 4, two of the leader pin access bores 134, 138, 142 and 146 on the clamp ring 102 align with leader pin receiving bores 170 and 172 that are formed in the body segment 103. Fastener receiving bores 180, 182, 184, 186, 188, 190, 192 and 194 rotatably align with the fastener receiving bores 150, 152, 154, 156, 158, 160, 162, and 164. The fastener receiving bores 180–194 are preferably threaded to engage threads of the fastener bolts. The rotational orientation of the clamp ring 102 will determine which of the fastener receiving bores 180–194 in the body segment 103 aligns with the fastener receiving bores 150–164 in the clamp ring 102. In a preferred embodiment, the fastener receiving bores 180–194 are threaded to receive the bolts that fasten the clamp ring 102 to the body segment 103. An axially projecting annular ring 200 abuts an inner surface 202 of the clamp ring 102. An upper surface 208 of the body segment 103 abuts a lower surface 210 of the clamp ring 102.

In use, the technician sometimes fails to fully retract the clamp cylinders 32 and 36. The clamp wedges 38 and 40 do not provide sufficient clearance to allow the radially extending engagement flange 104 to pass as the upper ram 26 and the upper ram adapter 28 are lowered. As a result, the clamp wedges 38 and 40 damage the upper surface 116 of the clamp ring 102.

The clamp ring 102 can be rotated (such as rotation by 90 degrees) and reattached to the body segment 103. Two of the leader pin access bores 134, 138, 142 and 146 align with the leader pin receiving bores 170 and 172 to allow the leader pins 66 and 70 to be accessed without requiring the removal of the clamp ring 102. The clamp ring 102 can be rotated three times before replacement is required. In other words, the clamp ring 102 can be damaged four times before requiring rework and/or replacement.

Figure 5:
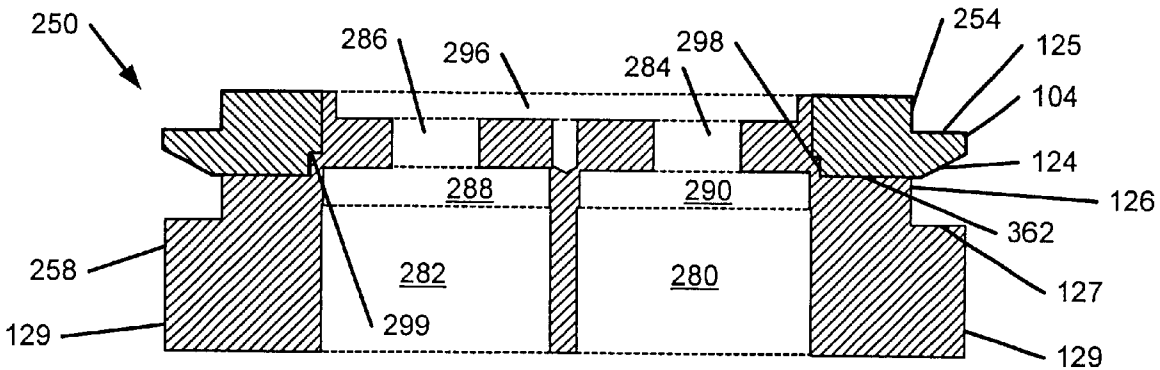
FIG. 5 is a sectional view of an upper mould holder according to a second embodiment of the invention.

Referring now to FIG. 5, an alternate upper mould holder 250 is illustrated and includes a rotatable and/or replacement clamp ring 254 and a body segment 258. The clamp ring 254 includes a radially extending engagement flange 104 that has a structure similar to the clamp ring of FIG. 2. Reference numbers from FIG. 2 have been used where appropriate to denote similar elements. The body segment 258 defines conventional mould openings 280 and 282, connecting bores 286 and 288, upper cylindrical mould cavities 288 and 290 and a cylindrical opening 296. The clamp ring 254 includes an annular notch 298 on a lower radially-inward edge thereof for receiving an annular projection 299 that is formed by the body segment 258.

Figure 6:
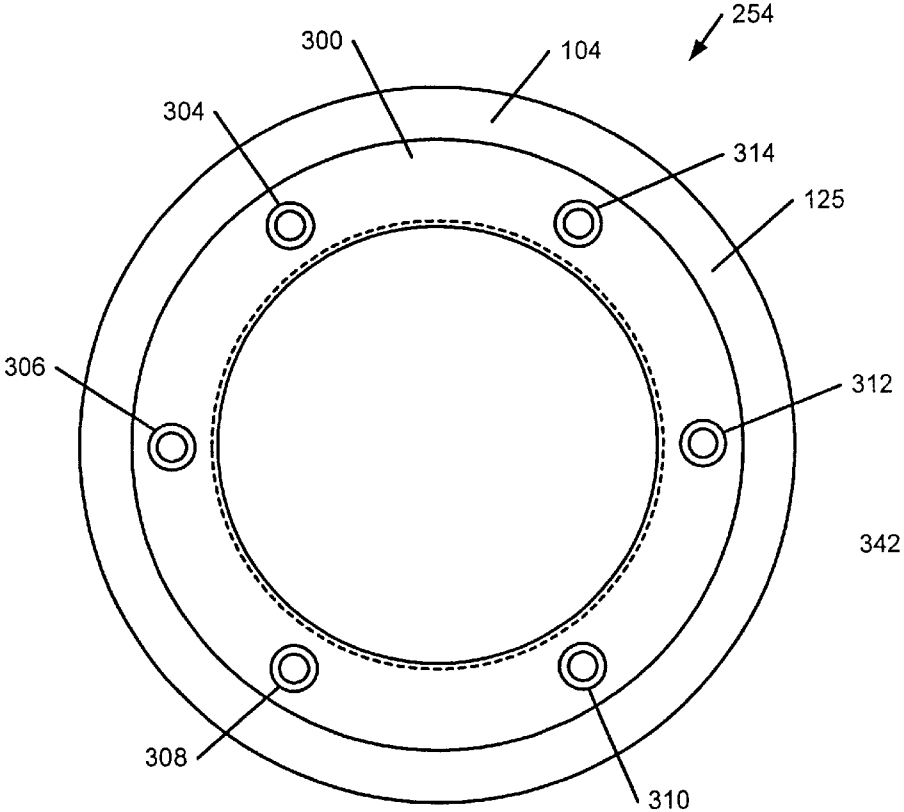
FIG. 6 is a plan view of the clamp ring that is associated with the upper mould holder shown in FIG. 5.

Referring now to FIG. 6, the clamp ring 254 includes an upper and inner surface 300 with fastener receiving bores 304, 306, 308, 310, 312 and 314 that are spaced at 60 degree intervals. The fastener receiving bores 304–314 are countersunk to allow the fastening bolts to be flush with the surface 300. The radially extending engagement flange 104 extends radially outward from the surface 300.

Figure 7:
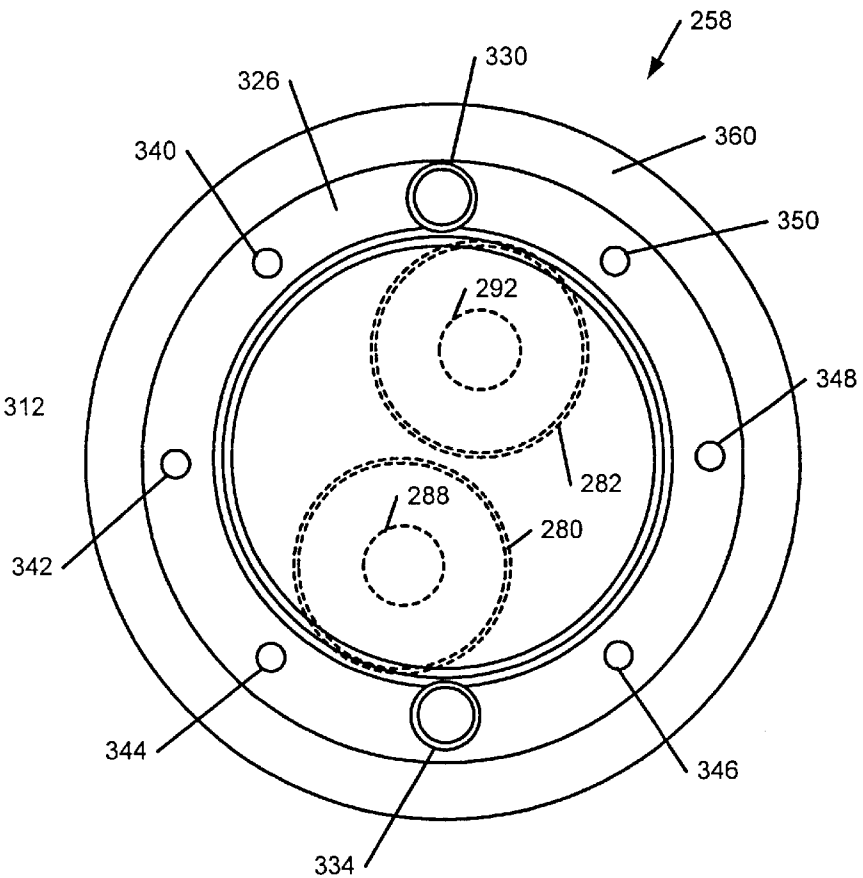
FIG. 7 is a plan view of the body segment of the die holder assembly shown in FIG. 5.

Referring now to FIG. 7, the body segment 258 includes an upwardly facing surface 326 that includes leader pin receiving bores 330 and 334 that are associated with the leader pins 66 and 70. Fastener receiving bores 340, 342, 344, 346, 348 and 350 are likewise spaced at 60 degree intervals so that they align with the fastener receiving bores 304–314. Preferably, the fastener receiving bores 340–350 are threaded to engage threads on the fastener bolts. The clamp ring 254 is attached to the body segment 258 using fastener bolts. An upwardly facing surface 360 abuts a lower surface 362 of the clamp ring 254.

The clamp ring 254 can be rotated (for example 60 degrees) when the clamp wedges 38 and 40 damage the upper surface 125 of the radially extending engagement flange 104. Access to the leader pins 66 and 70 is obtained by removing the clamp ring 254. The clamp ring 254 can be rotated five times (and damaged six times) before requiring rework and/or replacement.

As can be appreciated from the foregoing, the clamp rings and body segments according to the invention have been described in conjunction with horizontal die-casting machines and the die-casting of rotors for electric machines. Skilled artisans will appreciate that the present invention can be employed in vertical die-casting machines, with die sets, and/or with other types of parts.

The clamp rings and bodies according to the present invention reduce the frequency of machine repair and/or replacement of upper mould holders for die-casting machines. As a result, the owning and operating costs of the die-casting machines can be reduced. In addition, up time of the die-casting machines can be increased. Conventional upper mould holders can also be retrofitted by machining the upper portion of the upper mould holder to accept the clamp rings.

Those skilled in the art can now appreciate from the foregoing description that the broad teachings of the present invention can be implemented in a variety of forms. Therefore, while this invention has been described in connection with particular examples thereof, the true scope of the invention should not be so limited since other modifications will become apparent to the skilled practitioner upon a study of the drawings, the specification and the following claims.

What is claimed is:

1. A die-casting assembly comprising:

a ram;

a ram adapter that is connected to said ram;

a mould holder;

a mould that is connected to said mould holder;

a mould holder connector including a clamp cylinder that removably connects said mould holder to said ram adapter, wherein said mould holder includes a clamp ring that defines a radially projecting engagement flange for abutting an end of said clamp cylinder, and wherein said mould holder includes a body segment having a surface that is removably connected to said clamp ring in a plurality of angular positions.

2. The die-casting assembly of claim 1 wherein said clamp ring is annular and includes a first plurality of axial bores.

3. The die-casting assembly of claim 2 wherein said first plurality of axial bores provide access to leader pins that are connected to said body segment.

4. The die-casting assembly of claim 1 wherein said clamp ring includes two axial bores spaced 180 degrees apart.

5. The die-casting assembly of claim 1 wherein said clamp ring includes four axial bores spaced 90 degrees apart.

6. The die-casting assembly of claim 1 wherein said body segment includes a second plurality of axial bores for connecting leader pins to said body segment.

7. The die-casting assembly of claim 1 wherein said body segment includes two axial bores that are spaced 180 degrees apart.

8. The die-casting assembly of claim 1 wherein said clamp ring includes a third plurality of bores arranged in a first pattern for receiving fasteners that connect said clamp ring to said body segment.

9. The die-casting assembly of claim 8 wherein said body segment includes a fourth plurality of bores arranged in a second pattern for receiving and engaging said fasteners that connect said clamp ring to said body segment.

10. The die-casting assembly of claim 9 wherein said first and second patterns allow said clamp ring to be rotated in a plurality of angular positions.

11. An improved mould holder a die-casting machine comprising:

a clamp ring including an inner surface, an engagement flange projecting radially from said inner surface, and a first plurality of bores in said annular surface that are arranged in a first pattern; and a body segment defining an annular shoulder and a second plurality of bores arranged in a second pattern, wherein said first and second patterns align in a plurality of angular positions, and wherein said engagement flange of said clamp ring and said shoulder of said body segment define a recess for receiving and engaging an end of a clamp cylinder of a mould holder.

12. The improved mould holder of claim 11 wherein said clamp ring includes four axial leader pin bores in said inner surface that are spaced 90 degrees apart and said first plurality of bores are located between said axial leader pin bores and are spaced 30 degrees apart.

13. The improved mould holder of claim 12 wherein said body segment includes two axial access bores that are spaced 180 degrees apart and a first and second pair of fastening bores that are located on opposite sides of said axial access bores and are spaced at 30 degree intervals.

14. The improved mould holder of claim 11 wherein said plurality of fastening bores on said clamp ring are spaced 60 degrees apart.

15. The improved mould holder of claim 14 wherein said body segment includes two axial access bores that are spaced 180 degrees apart and said plurality of fastening bores are spaced at 60 degree intervals.

16. An improved mould holder a die-casting machine comprising:

a clamp ring including an inner surface, an engagement flange projecting radially from said inner surface, and a first plurality of bores in said annular surface; and a body segment defining an annular shoulder and a second plurality of bores arranged in a second pattern, wherein said first and second plurality of bores receive fastening bolts to removably attach said clamp ring to said body, and wherein said engagement flange of said clamp ring and said shoulder of said body segment define a recess for receiving and engaging an end of a clamp cylinder of a mould holder.

17. The improved mould holder of claim 16 wherein said first plurality of bores in said annular surface are arranged in a first pattern and said second plurality of bores are arranged in a second pattern, and wherein said first and second patterns align in a plurality of angular positions so that said clamp ring can be rotated and attached in said plurality of angular positions.

18. The improved mould holder of claim 17 wherein said clamp ring includes four axial leader pin bores in said inner surface that are spaced 90 degrees apart and said first plurality of bores are located between said axial leader pin bores and are spaced 30 degrees apart.

19. The improved mould holder of claim 18 wherein said body segment includes two axial access bores that are spaced 180 degrees apart and a first and second pair of fastening bores that are located on opposite sides of said axial access bores and are spaced at 30 degree intervals.

20. The improved mould holder of claim 16 wherein said plurality of fastening bores on said clamp ring are spaced 60 degrees apart.

21. The improved mould holder of claim 20 wherein said body segment includes two axial access bores that are spaced 180 degrees apart and said plurality of fastening bores are spaced at 60 degree intervals.

* * * * *